US011719198B1

(12) United States Patent
Dudar et al.

(10) Patent No.: US 11,719,198 B1
(45) Date of Patent: Aug. 8, 2023

(54) METHODS AND SYSTEMS FOR FUEL SYSTEM

(71) Applicant: Ford Global Technologies, LLC, Dearborn, MI (US)

(72) Inventors: Aed Dudar, Canton, MI (US); Scott Bohr, Novi, MI (US); Matthew Werner, Kenockee Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/816,846

(22) Filed: Aug. 2, 2022

(51) Int. Cl.
*F02M 25/08* (2006.01)

(52) U.S. Cl.
CPC ..... *F02M 25/0836* (2013.01); *F02M 25/089* (2013.01)

(58) Field of Classification Search
CPC ..... F02M 25/0836; F02M 25/089
See application file for complete search history.

(56) References Cited

U.S. PATENT DOCUMENTS 9,322,368 B2 4/2016 Arase et al.
9,732,685 B2 * 8/2017 Dudar ..... F02M 25/08
9,790,898 B2 10/2017 Dudar
10,830,189 B1 * 11/2020 Dudar ..... F02M 25/0836
11,047,321 B2 6/2021 Dudar
11,104,222 B2 * 8/2021 Dudar ..... B60K 15/03504
2009/0007890 A1 1/2009 Devries et al.
2021/0317803 A1 10/2021 Cronin et al.

FOREIGN PATENT DOCUMENTS

DE 112007001362 T5 7/2009

OTHER PUBLICATIONS

Dudar, A et al., "Onboard Refueling Vapor Recovery for Heavy Duty Applications" U.S. Appl. No. 17/449,219, filed Sep. 28, 2021, 70 pages.
Dudar, A et al., "Canister Capacity Diagnostics for Evaporative Emissions Control System in Heavy Duty Vehicles" U.S. Appl. No. 17/650,505, filed Feb. 9, 2022, 56 pages.
Dudar, A et al., "Methods and Systems for Fuel System" U.S. Appl. No. 17/653,108, filed Mar. 1, 2022, 47 pages.

* cited by examiner

*Primary Examiner* — Xiao En Mo
(74) *Attorney, Agent, or Firm* — Vincent Mastrogiacomo; McCoy Russell LLP

(57) ABSTRACT

Methods and systems are provided for an evaporative emission fuel (EVAP) system. In one example, a method for the EVAP system includes adjusting a vapor flow path to a plurality of canisters based on a canister load and a vehicle shut-off event occurring. The method further including flowing vapors to a less loaded canister later than to a more loaded canister.

20 Claims, 6 Drawing Sheets

METHODS AND SYSTEMS FOR FUEL SYSTEM

FIELD

The present description relates generally to methods and systems for a fuel system comprising parallel vapor canisters.

BACKGROUND/SUMMARY

Vehicle emission control systems may be configured to store vapors from a fuel tank refueling and diurnal engine operations in a vapor canister. This configuration is known as onboard fuel recovery and include the canister(s) being sized to adsorb vapors during refueling, running loss, hot soak, and vehicle off. The stored vapors may be purged during a later engine operating condition. The stored vapors may be routed to an engine intake for combustion, which may improve fuel economy.

Heavy duty vehicles may include offboard recovery vehicle emission control systems. Offboard recovery systems may not capture vapors during refueling, which may allow canisters thereof to be sized smaller than an onboard configuration. However, upcoming government regulations may require heavy duty vehicle to include onboard recovery vehicle emission control systems.

Heavy duty vehicles may include relatively large fuel tanks compared to passenger vehicles. A single large canister in a heavy duty vehicle may present restrictions during refueling, which may lead to premature refueling pump shut-off. Thus, a series canister arrangement may only work up to a determined fuel tank size. Parallel canister arrangements in heavy duty vehicles may be prone to releasing vapors during long vehicle shut-off events with high diurnal temperatures due to vapors passing through a more loaded of the canisters. Thus, a canister sizing and arrangement for onboard vapor recovery in heavy duty vehicles is desired In one example, the issues described above may be addressed by a method for an evaporative emission control (EVAP) system including flowing vapors to canisters in parallel outside of a purging event and a refueling event. The method further comprising during a vehicle shut-off event not comprising the refueling event, flowing vapors to the canisters in series with a less loaded canister fluidly downstream a more loaded canister. In this way, vapor leak from more loaded canisters may be captured by the less loaded canister during the vehicle shut-off event.

As one example, the EVAP system may include three multi-position valves configured to adjust vapor flow from the fuel tank to the canisters and from the canisters to atmosphere. The positions of the valves may be adjusted based on conditions to redirect vapor flow. The vapor flow may be adjusted such that a fluid order of the canisters is changed to arranged the least loaded canister in the downstream position. Since the more loaded canister may be more likely to leak vapors during the vehicle shut-off, arranging the least loaded canister may reduce an amount of vapors leaked to atmosphere. By doing this, the order in which the canisters receive vapors may be adjusted without physically changing a position of the canisters.

In one example, a method includes fluidly repositioning a plurality of canisters in response to a vehicle shut-off event extending for greater than a determined duration. The plurality of canisters may be immovable, wherein actuation of one or more multi-way bleed valves and vent valves may adjust a vapor flow path such that a fluid positioning of the plurality of canisters is adjusted. For example, a default open position of the bleed valves and the vent valves may result in each of the plurality of canisters receiving vapors from a fuel time at substantially similar times, wherein the default open position is selected during purging events or refueling events. For vehicle shut-off events greater than a determined duration, the bleed valve may be adjusted to flow vapors initially to a most loaded canister. The vapor flow path may be adjusted, via actuation of the vent valves, to flow vapors to the remaining canisters, which are arranged based on load with less loaded canisters arranged downstream of more loaded canisters in the direction of vapor flow. The EVAP system may include one or more divert passages configured to flow vapors from a vent valve of a canister to a load line of another canister. By doing this, vapors that may leak from more loaded canisters due to diurnal temperatures may be captured by less loaded canisters, which may be less prone to leaking vapors.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 1:
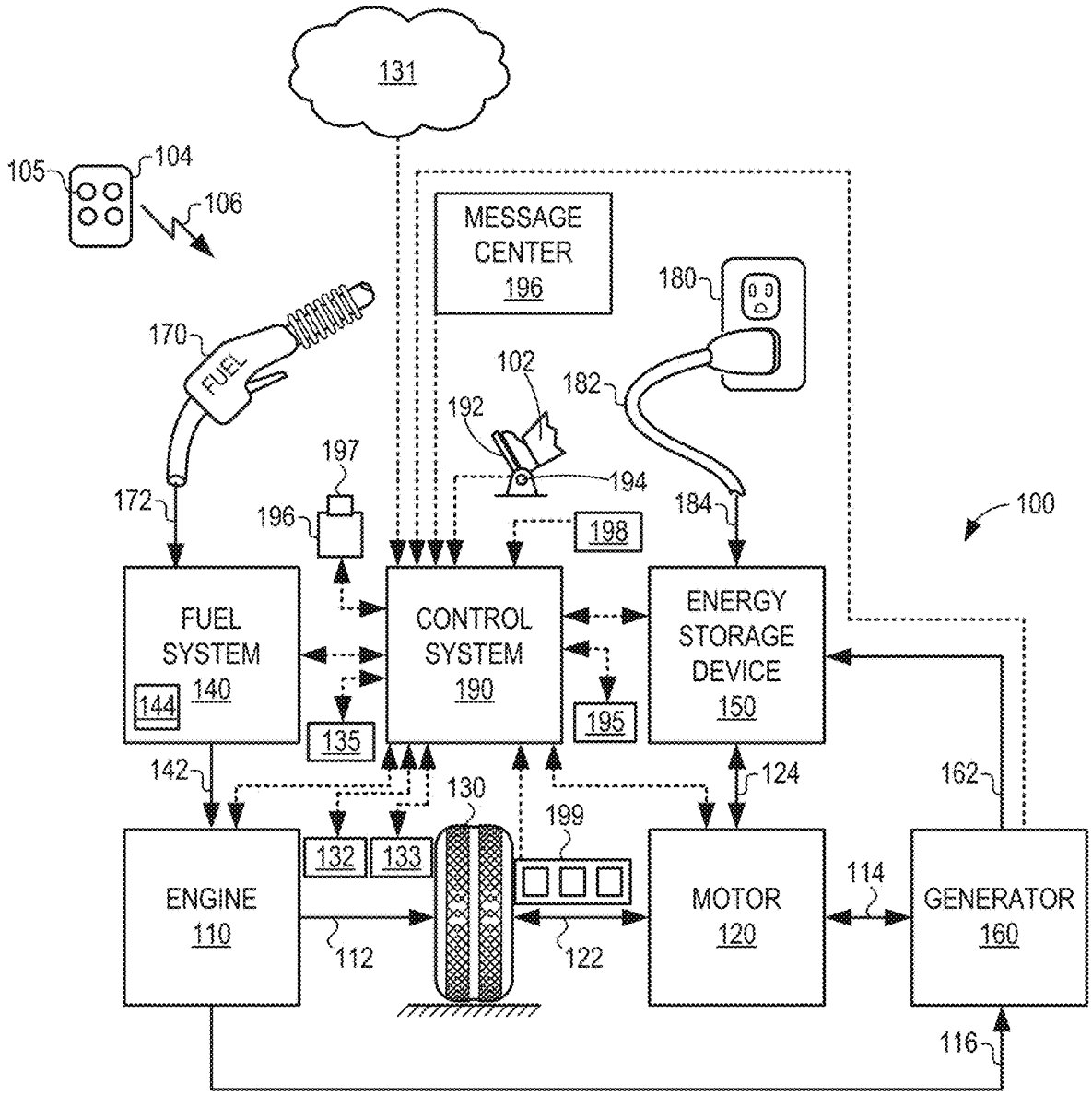
FIG. 1 illustrates a schematic of an engine included in a hybrid vehicle.
Figure 2:
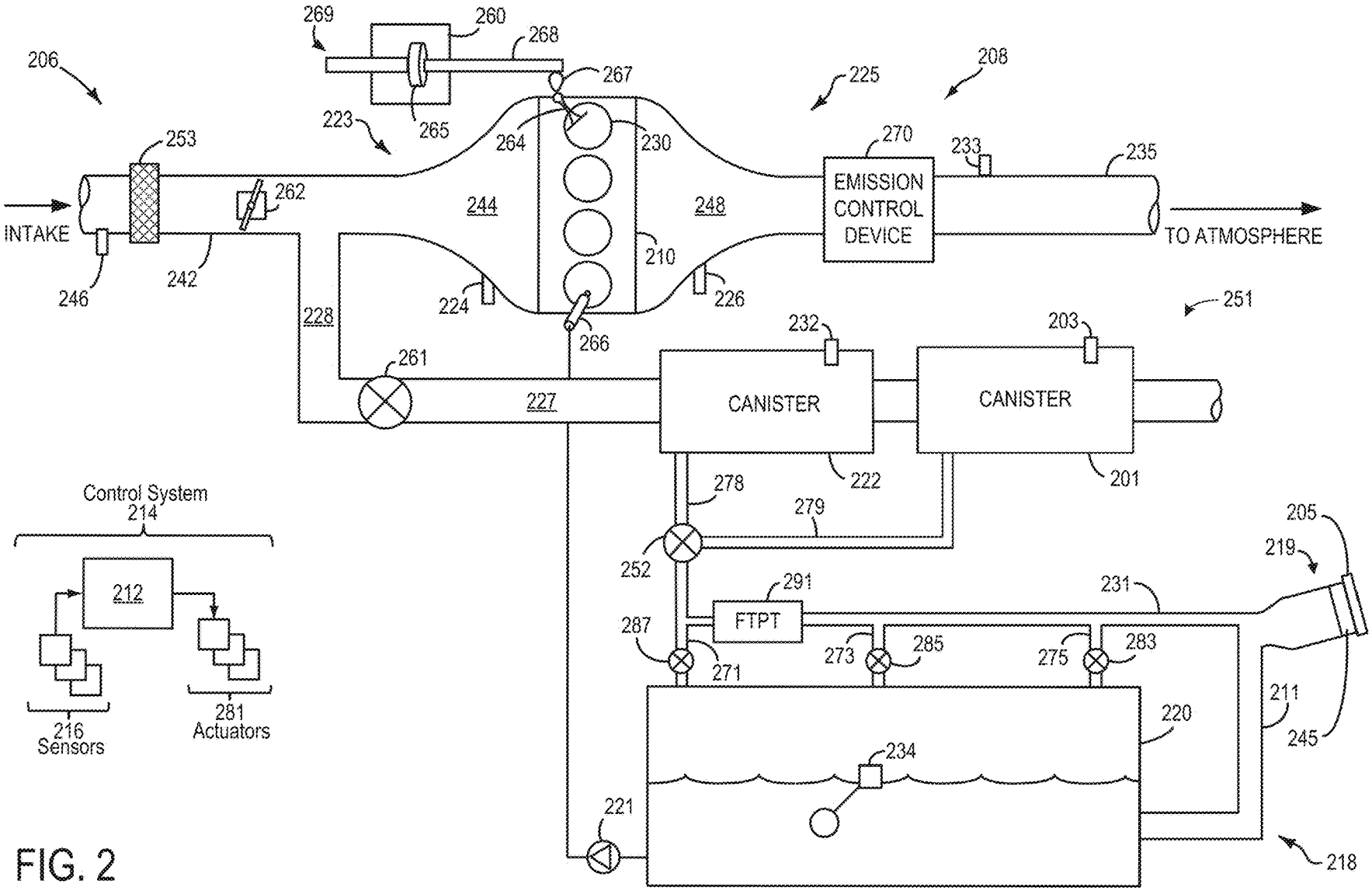
FIG. 2. illustrates an example of an engine including a plurality of canisters.
Figure 3:
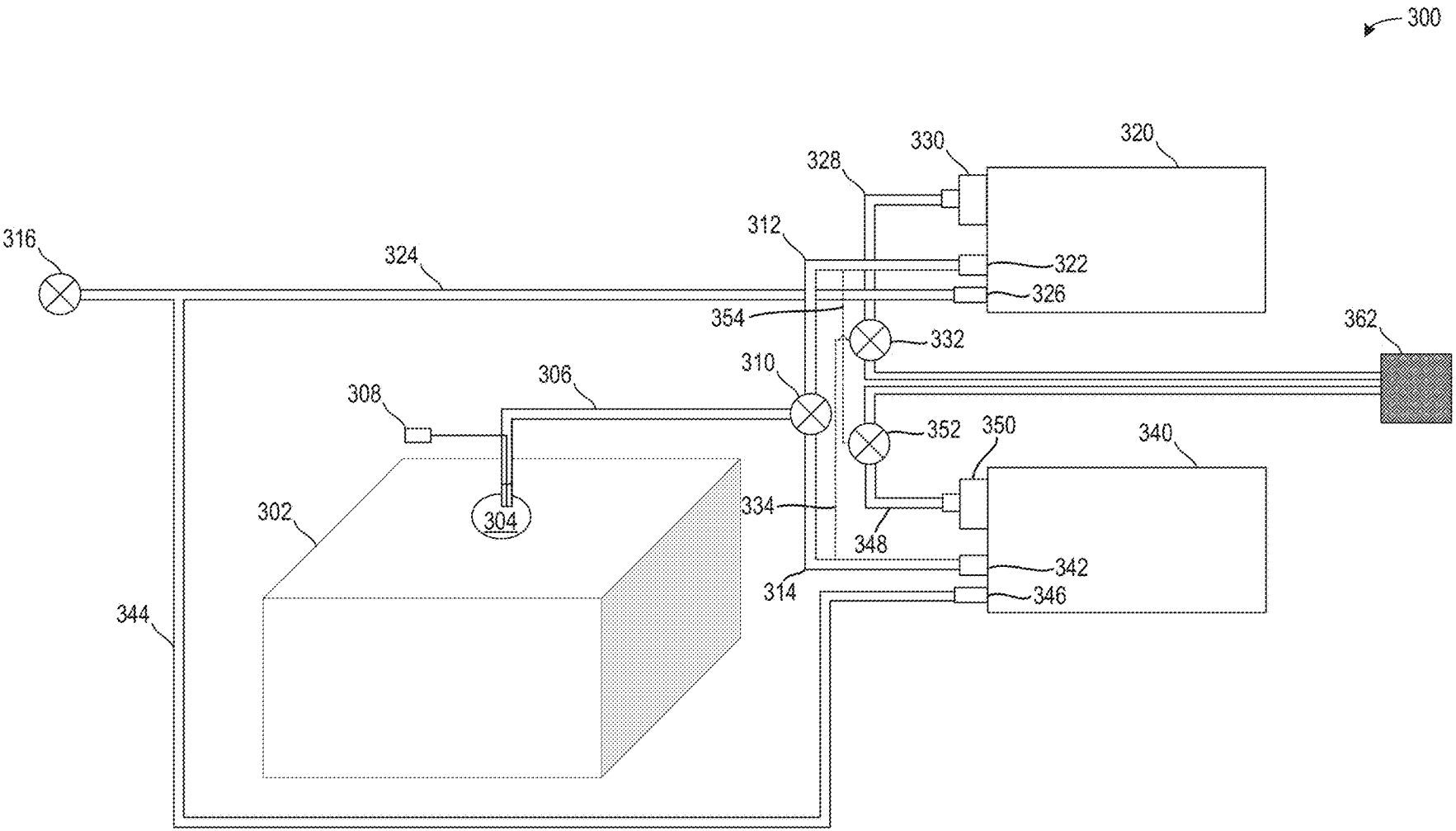
FIG. 3 illustrates the plurality of canisters including a plurality of multi-position valves.
Figure 4:
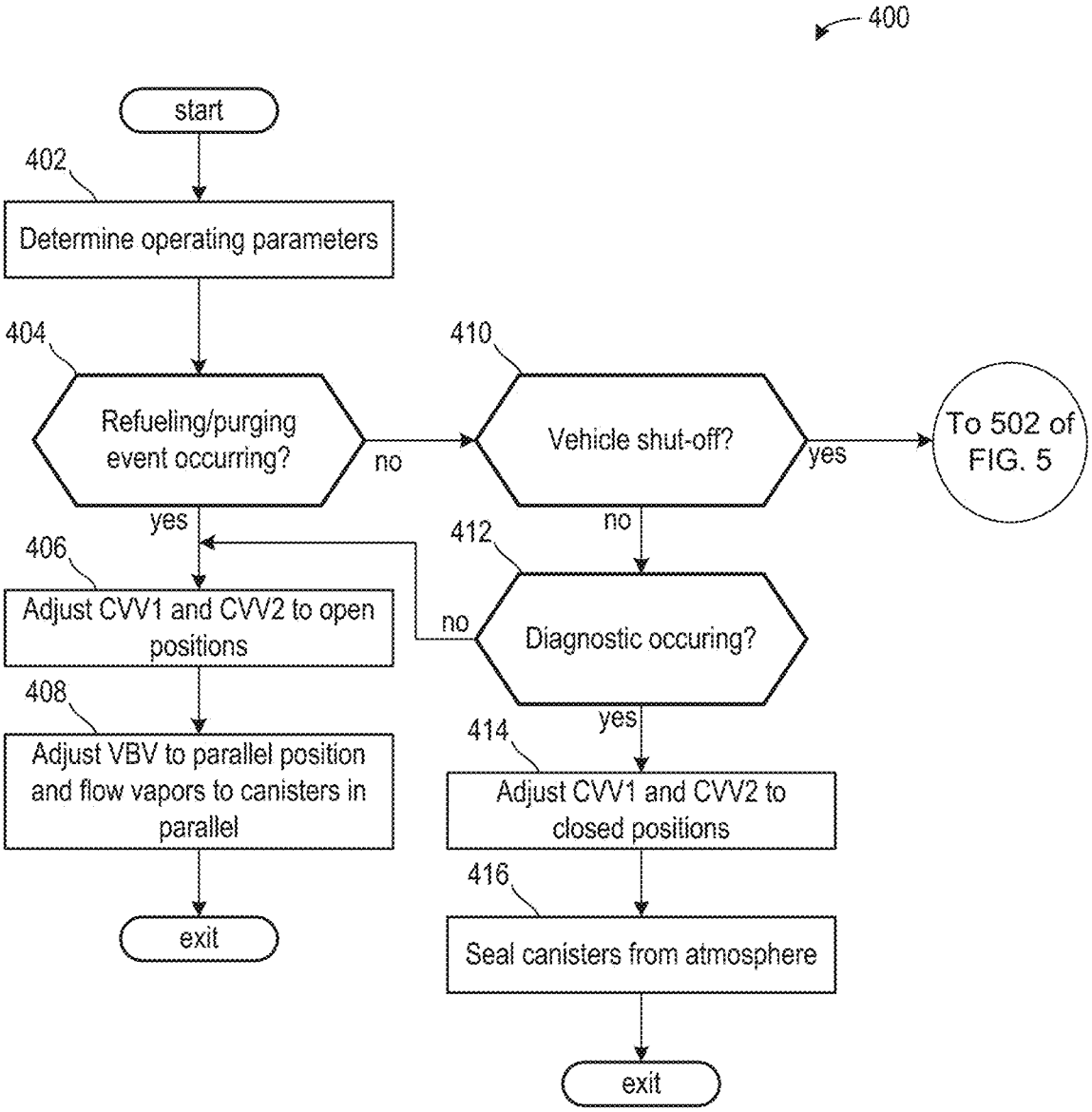
FIGS. 4 and 5 illustrate methods for flowing vapors to the canisters during and outside of a vehicle shut-off event.
Figure 5:
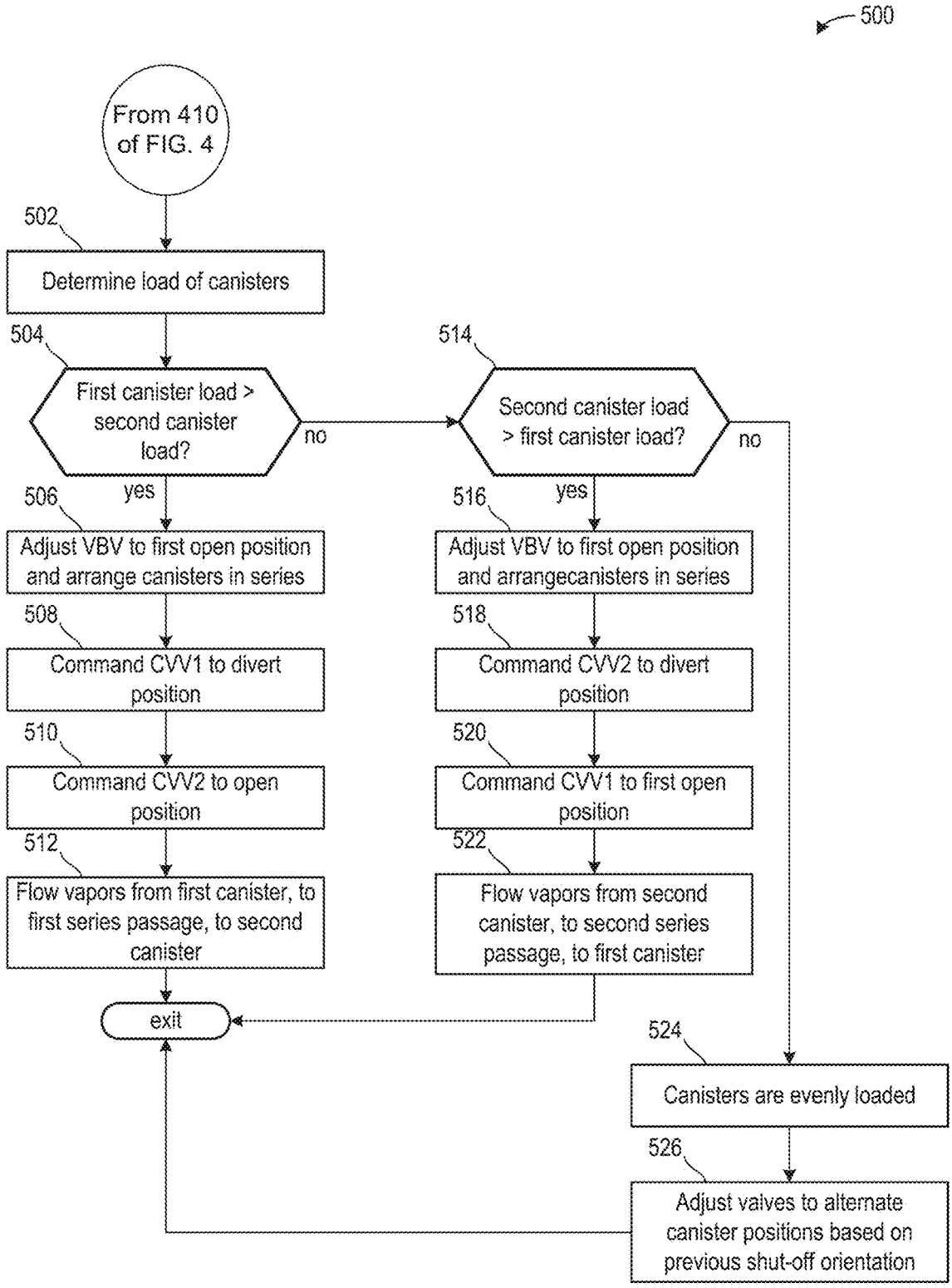
Figure 6:
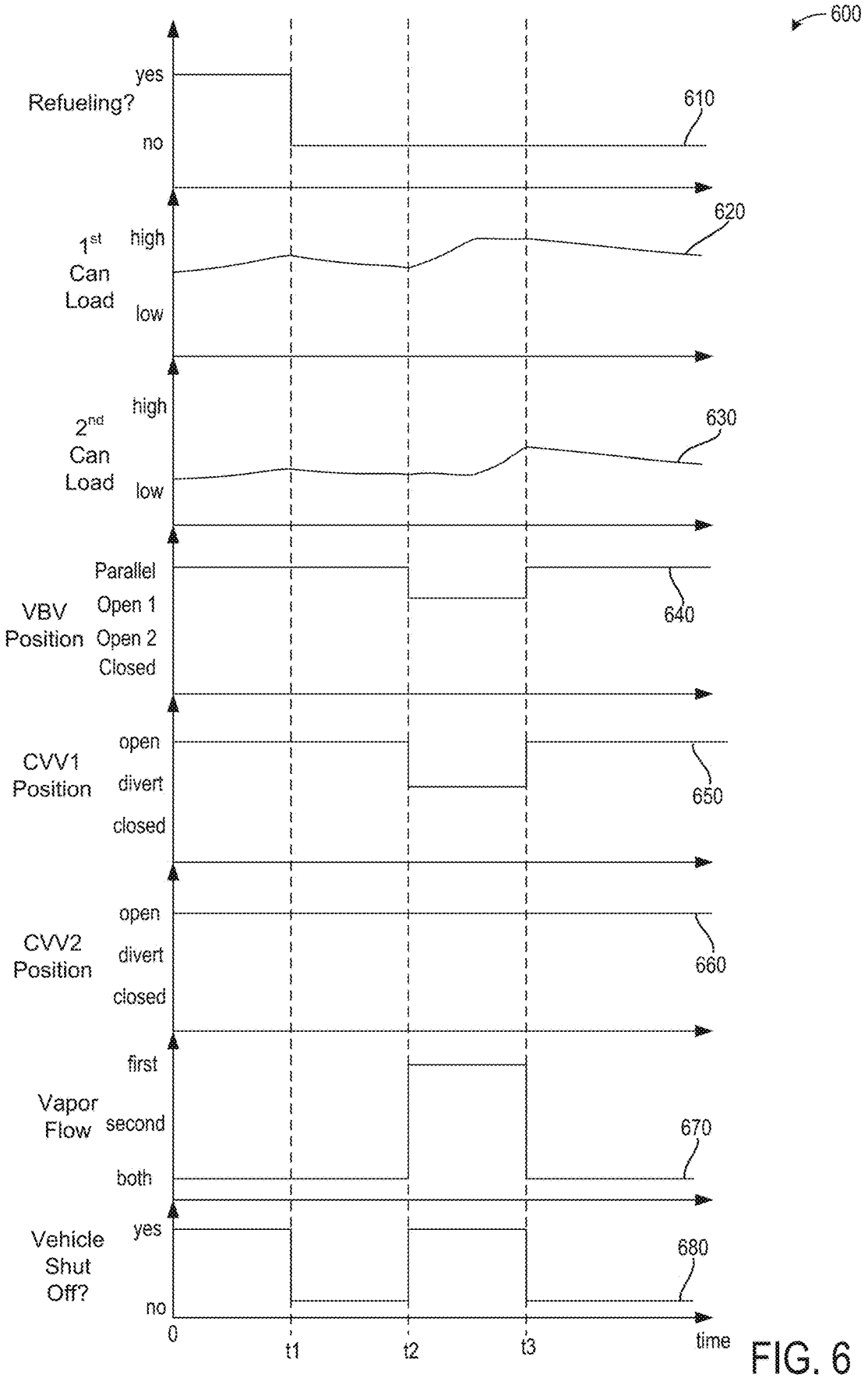
FIG. 6 graphically illustrates an engine operating sequence illustrating changes in vapor flow during a refueling event and the vehicle shut-off event.

The following description relates to systems and methods for flowing vapors to parallel canisters of an evaporative emission control (EVAP) system. FIG. 1 illustrates a schematic of an engine included in a hybrid vehicle. FIG. 2. illustrates a prior art example of an engine including a single canister. FIG. 3 illustrates the engine including canisters arranged in parallel. FIG. 4 illustrates a method for flowing vapors to a plurality of canisters in response to a refueling event, a purging event, or a diagnostic of the EVAP system. FIG. 5 illustrates a method for flowing vapors to the plurality of canisters during a vehicle shut-off event without the refueling event. FIG. 6 graphically illustrates an engine operating sequence illustrating changes in vapor flow during a refueling event.

FIGS. 1-3 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. It will be appreciated that one or more components referred to as being "substantially similar and/or identical" differ from one another according to manufacturing tolerances (e.g., within 1-5% deviation).

FIG. 1 illustrates an example vehicle propulsion system 100. Vehicle propulsion system 100 includes a fuel burning engine 110 and a motor 120. As a non-limiting example, engine 110 comprises an internal combustion engine and motor 120 comprises an electric motor. Motor 120 may be configured to utilize or consume a different energy source than engine 110. For example, engine 110 may consume a liquid fuel (e.g., gasoline) to produce an engine output while motor 120 may consume electrical energy to produce a motor output. As such, a vehicle with propulsion system 100 may be referred to as a hybrid electric vehicle (HEV).

Vehicle propulsion system 100 may utilize a variety of different operational modes depending on operating conditions encountered by the vehicle propulsion system. Some of these modes may enable engine 110 to be maintained in an off state (i.e., set to a deactivated state) where combustion of fuel at the engine is discontinued. For example, under select operating conditions, motor 120 may propel the vehicle via drive wheel 130 as indicated by arrow 122 while engine 110 is deactivated.

During other operating conditions, engine 110 may be set to a deactivated state (as described above) while motor 120 may be operated to charge energy storage device 150. For example, motor 120 may receive wheel torque from drive wheel 130 as indicated by arrow 122 where the motor may convert the kinetic energy of the vehicle to electrical energy for storage at energy storage device 150 as indicated by arrow 124. This operation may be referred to as regenerative braking of the vehicle. Thus, motor 120 can provide a generator function in some examples. However, in other examples, generator 160 may instead receive wheel torque from drive wheel 130, where the generator may convert the kinetic energy of the vehicle to electrical energy for storage at energy storage device 150 as indicated by arrow 162.

During still other operating conditions, engine 110 may be operated by combusting fuel received from fuel system 140 as indicated by arrow 142. For example, engine 110 may be operated to propel the vehicle via drive wheel 130 as indicated by arrow 112 while motor 120 is deactivated. During other operating conditions, both engine 110 and motor 120 may each be operated to propel the vehicle via drive wheel 130 as indicated by arrows 112 and 122, respectively. A configuration where both the engine and the motor may selectively propel the vehicle may be referred to as a parallel type vehicle propulsion system. Note that in some examples, motor 120 may propel the vehicle via a first set of drive wheels and engine 110 may propel the vehicle via a second set of drive wheels.

In other examples, vehicle propulsion system 100 may be configured as a series type vehicle propulsion system, whereby the engine does not directly propel the drive wheels. Rather, engine 110 may be operated to power motor 120, which may in turn propel the vehicle via drive wheel 130 as indicated by arrow 122. For example, during select operating conditions, engine 110 may drive generator 160 as indicated by arrow 116, which may in turn supply electrical energy to one or more of motor 120 as indicated by arrow 114 or energy storage device 150 as indicated by arrow 162. As another example, engine 110 may be operated to drive motor 120 which may in turn provide a generator function to convert the engine output to electrical energy, where the electrical energy may be stored at energy storage device 150 for later use by the motor.

Fuel system 140 may include one or more fuel storage tanks 144 for storing fuel on-board the vehicle. For example, fuel tank 144 may store one or more liquid fuels, including but not limited to: gasoline, diesel, and alcohol fuels. In some examples, the fuel may be stored on-board the vehicle as a blend of two or more different fuels. For example, fuel tank 144 may be configured to store a blend of gasoline and ethanol (e.g., E10, E85, etc.) or a blend of gasoline and methanol (e.g., M10, M85, etc.), whereby these fuels or fuel blends may be delivered to engine 110 as indicated by arrow 142. Still other suitable fuels or fuel blends may be supplied to engine 110, where they may be combusted at the engine to produce an engine output. The engine output may be utilized to propel the vehicle as indicated by arrow 112 or to recharge energy storage device 150 via motor 120 or generator 160.

In some examples, energy storage device 150 may be configured to store electrical energy that may be supplied to other electrical loads residing on-board the vehicle (other than the motor), including cabin heating and air conditioning, engine starting, headlights, cabin audio and video systems, etc. As a non-limiting example, energy storage device 150 may include one or more batteries and/or capacitors.

Control system 190 may communicate with one or more of engine 110, motor 120, fuel system 140, energy storage device 150, and generator 160. Control system 190 may receive sensory feedback information from one or more of engine 110, motor 120, fuel system 140, energy storage device 150, and generator 160. Further, control system 190 may send control signals to one or more of engine 110, motor 120, fuel system 140, energy storage device 150, and generator 160 responsive to this sensory feedback. Control system 190 may receive an indication of an operator requested output of the vehicle propulsion system from a vehicle operator 102. For example, control system 190 may receive sensory feedback from pedal position sensor 194 which communicates with pedal 192. Pedal 192 may refer schematically to a brake pedal and/or an accelerator pedal. Furthermore, in some examples control system 190 may be in communication with a remote engine start receiver 195 (or transceiver) that receives wireless signals 106 from a key fob 104 having a remote start button 105. In other examples (not shown), a remote engine start may be initiated via a cellular telephone, or smartphone based system where a user's cellular telephone sends data to a server and the server communicates with the vehicle to start the engine.

Energy storage device 150 may periodically receive electrical energy from a power source 180 residing external to the vehicle (e.g., not part of the vehicle) as indicated by arrow 184. As a non-limiting example, vehicle propulsion system 100 may be configured as a plug-in hybrid electric vehicle (PHEV), whereby electrical energy may be supplied to energy storage device 150 from power source 180 via an electrical energy transmission cable 182. During a recharging operation of energy storage device 150 from power source 180, electrical transmission cable 182 may electrically couple energy storage device 150 and power source 180. While the vehicle propulsion system is operated to propel the vehicle, electrical transmission cable 182 may be disconnected between power source 180 and energy storage device 150. Control system 190 may identify and/or control the amount of electrical energy stored at the energy storage device, which may be referred to as the state of charge (SOC).

In other examples, electrical transmission cable 182 may be omitted, where electrical energy may be received wirelessly at energy storage device 150 from power source 180. For example, energy storage device 150 may receive electrical energy from power source 180 via one or more of electromagnetic induction, radio waves, and electromagnetic resonance. As such, it should be appreciated that any suitable approach may be used for recharging energy storage device 150 from a power source that does not comprise part of the vehicle. In this way, motor 120 may propel the vehicle by utilizing an energy source other than the fuel utilized by engine 110.

Fuel system 140 may periodically receive fuel from a fuel source residing external to the vehicle. As a non-limiting example, vehicle propulsion system 100 may be refueled by receiving fuel via a fuel dispensing device 170 as indicated by arrow 172. In some examples, fuel tank 144 may be configured to store the fuel received from fuel dispensing device 170 until it is supplied to engine 110 for combustion. In some examples, control system 190 may receive an indication of the level of fuel stored at fuel tank 144 via a fuel level sensor. The level of fuel stored at fuel tank 144 (e.g., as identified by the fuel level sensor) may be communicated to the vehicle operator, for example, via a fuel gauge or indication in a vehicle instrument panel 196.

The vehicle propulsion system 100 may also include an ambient temperature/humidity sensor 198, and a roll stability control sensor, such as a lateral and/or longitudinal and/or yaw rate sensor(s) 199. The vehicle instrument panel 196 may include indicator light(s) and/or a text-based display in which messages are displayed to an operator. The vehicle instrument panel 196 may also include various input portions for receiving an operator input, such as buttons, touch screens, voice input/recognition, etc. For example, the vehicle instrument panel 196 may include a refueling button 197 which may be automatically actuated or pressed by a vehicle operator to initiate refueling. For example, in response to the vehicle operator actuating refueling button 197, a fuel tank in the vehicle may be depressurized so that refueling may be performed.

In some examples, vehicle propulsion system 100 may include one or more onboard cameras 135. Onboard cameras 135 may communicate photos and/or video images to control system 190, for example. Onboard cameras may in some examples be utilized to record images within a predetermined radius of the vehicle, for example.

Vehicle system 100 may also include an on-board navigation system 132 (for example, a Global Positioning System) with which an operator of the vehicle may interact. The navigation system 132 may include one or more location sensors for assisting in estimating vehicle speed, vehicle altitude, vehicle position/location, etc. This information may be used to infer engine operating parameters, such as local barometric pressure. As discussed above, control system 190 may further be configured to receive information via the internet or other communication networks. Information received from the GPS may be cross-referenced to information available via the internet to determine local weather conditions, local vehicle regulations, etc. In some examples, vehicle system 100 may include lasers, radar, sonar, acoustic sensors 133, which may enable vehicle location, traffic information, etc., to be collected via the vehicle.

The vehicle system 100 may be in wireless communication with a wireless network 131. The control system 190 may communicate with the wireless network 131 via a modem, a router, a radio signal, or the like. Data regarding various vehicle system conditions may be communicated between the control system 190 and the wireless network. Additionally or alternatively, the wireless network 131 may communicate conditions of other vehicles to the control system 190.

FIG. 2 shows a schematic depiction of a prior art example of a vehicle system 206. The vehicle system 206 includes an engine system 208 coupled to an evaporative emissions control system 251 and a fuel system 218. Evaporative emissions control system 251 (also termed, evaporative emissions system 251) includes a first canister 222 and a second canister 201 which may be used to capture and store fuel vapors. While only two canisters are illustrated, the evaporative emission control system 251 may include three or more canisters. In some examples, vehicle system 206 may be a hybrid electric vehicle system, such as the vehicle propulsion system 100 of FIG. 1. As such, engine 210 may be similar to engine 110 of FIG. 1 while control system 214 of FIG. 2 may be the same as control system 190 of FIG. 1.

The engine system 208 may include an engine 210 having a plurality of cylinders 230. The engine 210 includes an engine intake 223 and an engine exhaust 225. The engine intake 223 includes a throttle 262 fluidly coupled to the intake manifold 244. Fresh intake air enters intake passage 242 and flows through air filter 253. Air filter 253 positioned in the intake passage 242 may clean intake air before the intake air is directed to the intake manifold 244. Cleaned intake air exiting the air filter 253 may stream past throttle 262 (also termed intake throttle 262) into intake manifold 244 via intake passage 242. As such, intake throttle 262 when fully opened may enable a higher level of fluidic communication between intake manifold 244 and intake passage 242 downstream of air filter 253. An amount of intake air provided to the intake manifold 244 may be regulated via throttle 262 based on engine conditions. The engine exhaust 225 includes an exhaust manifold 248 leading to an exhaust passage 235 that routes exhaust gas to the atmosphere. The engine exhaust 225 may include one or more emission control devices 270, which may be mounted in a close-coupled position in the exhaust. One or more emission control devices may include a three-way catalyst, lean NO trap, diesel particulate filter, oxidation catalyst, etc. It will be appreciated that other components may be included in the engine such as a variety of valves and sensors.

Each cylinder 230 may be serviced by one or more valves. In the present example, each cylinder 30 includes a corresponding intake valve 264 and an exhaust valve (not shown). Each intake valve 264 may be held at a desired position via a corresponding spring. Engine system 208 further includes one or more camshafts 268 for operating intake valve 262. In the depicted example, intake camshaft 268 is coupled to intake valve 264 and can be actuated to operate intake valve 264. In some embodiments, where the intake valve of a plurality of cylinders 230 are coupled to a common camshaft, intake camshaft 268 can be actuated to operate all the intake valves of all the coupled cylinders.

Intake valve 264 is actuatable between an open position that allows intake air into the corresponding cylinder and a closed position substantially blocking intake air from the cylinder. Intake camshaft 268 may be included in intake valve actuation system 269. Intake camshaft 268 includes intake cam 267 which has a cam lobe profile for opening intake valve 264 for a defined intake duration. The lobe profile may affect cam lift height, cam duration, and/or cam timing. A controller, such as controller 212, may be able to switch the intake valve duration by moving intake camshaft 268 longitudinally and switching between cam profiles.

It will be appreciated that the intake and/or exhaust camshafts may be coupled to cylinder subsets, and multiple intake and/or exhaust camshafts may be present. Intake valve actuation system 269 may further include push rods, rocker arms, tappets, etc. As such, the intake valve actuation system may include a plurality of electromechanical actuators. Such devices and features may control actuation of the intake valve 264 by converting rotational motion of the cams into translational motion of the valves. As previously discussed, the valves can also be actuated via additional cam lobe profiles on the camshafts, where the cam lobe profiles between the different valves may provide varying cam lift height, cam duration, and/or cam timing. However, alternative camshaft (overhead and/or pushrod) arrangements could be used, if desired. Further, in some examples, cylinders 230 may each have more than one intake valve. In still other examples, each intake valve 264 of one or more cylinders may be actuated by a common camshaft. Further still, in some examples, some of the intake valves 264 may be actuated by their own independent camshaft or other device.

Engine system 208 may include variable valve timing systems, for example, variable cam timing VCT system 260. As such, VCT system 260 may be operatively and communicatively coupled to the intake valve actuation system 269. VCT system 260 may include an intake camshaft phaser 265 coupled to the common intake camshaft 268 for changing intake valve timing. VCT system 260 may be configured to advance or retard valve timing by advancing or retarding cam timing and may be controlled by controller 212. In some embodiments, valve timing such as intake valve closing (IVC) may be varied by a continuously variable valve lift (CVVL) device.

The valve/cam control devices and systems described above may be hydraulically powered, or electrically actuated, or combinations thereof. In one example, a position of the camshaft may be changed via cam phase adjustment of an electrical actuator (e.g., an electrically actuated cam phaser) with a fidelity that exceeds that of most hydraulically operated cam phasers. Signal lines can send control signals to and receive a cam timing and/or cam selection measurement from VCT system 260. As such, the valve actuation systems described above may enable closing the intake valves to block fluid flow therethrough, when desired.

Though not shown in FIG. 2, vehicle system 206 may also include an exhaust gas recirculation (EGR) system for routing a desired portion of exhaust gas from the exhaust passage 235 to the intake manifold 244 via an EGR passage. The amount of EGR provided may be varied by controller 212 via adjusting an EGR valve in the EGR passage. By introducing exhaust gas to the engine 210, the amount of available oxygen for combustion is decreased, thereby reducing combustion flame temperatures and reducing the formation of $NO_x$, for example.

Fuel system 218 may include a fuel tank 220 coupled to a fuel pump system 221. The fuel pump system 221 may include one or more pumps for pressurizing fuel delivered to the injectors of engine 210, such as the example injector 266. While only a single injector 266 is shown, additional injectors are provided for each cylinder. It will be appreciated that fuel system 218 may be a return-less fuel system, a return fuel system, or various other types of fuel system. Fuel tank 220 may hold a plurality of fuel blends, including fuel with a range of alcohol concentrations, such as various gasoline-ethanol blends, including E10, E85, gasoline, etc., and combinations thereof. A fuel level sensor 234 located in fuel tank 220 may provide an indication of the fuel level ("Fuel Level Input") to controller 212. As depicted, fuel level sensor 234 may comprise a float connected to a variable resistor. Alternatively, other types of fuel level sensors may be used.

Vapors generated in fuel system 218 may be routed to evaporative emissions control system 251, which includes the first fuel vapor canister 222 and the second fuel canister 201, via vapor recovery line 231. The first fuel vapor canister 222 may also be simply termed first canister 222 and the second fuel vapor canister 201 may be termed second canister 201 herein. Fuel vapors stored in first canister 222 and the second canister 201 may be purged to the engine intake 223 at a later time. Vapor recovery line 231 may be coupled to fuel tank 220 via one or more conduits and may include one or more valves for isolating the fuel tank during certain conditions. For example, vapor recovery line 231 may be coupled to fuel tank 220 via one or more or a combination of conduits 271, 273, and 275.

Further, in some examples, one or more fuel tank vent valves in conduits 271, 273, or 275. Among other functions, fuel tank vent valves may allow a fuel vapor canister of the emissions control system to be maintained at a low pressure or vacuum without increasing the fuel evaporation rate from the tank (which would otherwise occur if the fuel tank pressure were lowered). For example, conduit 271 may include a grade vent valve (GVV) 287, conduit 273 may include a fill limit venting valve (FLVV) 285, and conduit 275 may include a grade vent valve (GVV) 283. Further, in some examples, recovery line 231 may be coupled to a fuel filler system 219 (or refueling system 219). In some examples, fuel filler system may include a fuel cap 205 for sealing off the fuel filler system from the atmosphere. Refueling system 219 is coupled to fuel tank 220 via a fuel filler pipe or neck 211.

Further, refueling system 219 may include refueling lock 245. In some embodiments, refueling lock 245 may be a fuel cap locking mechanism. The fuel cap locking mechanism may be configured to automatically lock the fuel cap in a closed position so that the fuel cap cannot be opened. For example, the fuel cap 205 may remain locked via refueling lock 245 while pressure or vacuum in the fuel tank is greater than a threshold. In response to a refuel request, e.g., a vehicle operator initiated request, the fuel tank may be depressurized and the fuel cap unlocked after the pressure or vacuum in the fuel tank falls below a threshold. A fuel cap locking mechanism may be a latch or clutch, which, when engaged, prevents the removal of the fuel cap. The latch or clutch may be electrically locked, for example, by a solenoid, or may be mechanically locked, for example, by a pressure diaphragm.

In some embodiments, refueling lock 245 may be a filler pipe valve located at a mouth of fuel filler pipe 211. In such embodiments, refueling lock 245 may not prevent the removal of fuel cap 205. Rather, refueling lock 245 may prevent the insertion of a refueling pump into fuel filler pipe 211. The filler pipe valve may be electrically locked, for example by a solenoid, or mechanically locked, for example by a pressure diaphragm.

In some embodiments, refueling lock 245 may be a refueling door lock, such as a latch or a clutch which locks a refueling door located in a body panel of the vehicle. The refueling door lock may be electrically locked, for example by a solenoid, or mechanically locked, for example by a pressure diaphragm.

In embodiments where refueling lock 245 is locked using an electrical mechanism, refueling lock 245 may be unlocked by commands from controller 212, for example, when a fuel tank pressure decreases below a pressure threshold. In embodiments where refueling lock 245 is locked using a mechanical mechanism, refueling lock 245 may be unlocked via a pressure gradient, for example, when a fuel tank pressure decreases to atmospheric pressure.

Evaporative emissions control system 251 may include one or more emissions control devices, such as one or more fuel vapor canisters filled with an appropriate adsorbent. The canisters are configured to temporarily trap fuel vapors (including vaporized hydrocarbons) during fuel tank refilling operations and "running loss" (that is, fuel vaporized during vehicle operation). In one example, the adsorbent used is activated charcoal. Evaporative emissions system 251 may further include a canister ventilation path or vent line 227 which may route gases out of the canister 222 to the atmosphere when storing, or trapping, fuel vapors from fuel system 218.

Vent line 227 may allow fresh air to be drawn into canister 222 when purging stored fuel vapors from first canister 222 and second canister 201 to engine intake 223 via purge line 228 and canister purge valve 261 (also termed, purge valve 261). For example, purge valve 261 may be normally closed but may be opened during certain conditions so that vacuum from engine intake manifold 244 is provided to the fuel vapor canister 222 for purging.

FTIV 252 may be positioned between the fuel tank 220, the first canister 222, and the second canister 201 within conduit 278. FTIV 252 may be a normally closed valve, that when opened, allows for the venting of fuel vapors from fuel tank 220 to only first canister 222 via conduit 278, only second canister 201 via conduit 279, or both. Fuel vapors may be stored within the first canister 222 and the second canister 201, stripped off fuel vapors, may then be vented to atmosphere via vent line 227. Fuel vapors stored in first canister 222 and the second canister 201 may be purged along purge line 228 to engine intake 223 via canister purge valve 261 at a later time when purging conditions exist. As such, FTIV 252 when closed may isolate and seal the fuel tank 220 from the evaporative emissions system 251. It will be noted that certain vehicle systems may not include FTIV 252.

Fuel system 218 may be operated by controller 212 in a plurality of modes by selective adjustment of the various valves and solenoids. For example, the fuel system may be operated in a fuel vapor storage mode (e.g., during a fuel tank refueling operation and with the engine not running), wherein the controller 212 may open FTIV 252 while closing canister purge valve (CPV) 261 to direct refueling vapors into first and second canisters and preventing fuel vapors from being directed into the intake manifold.

As another example, the fuel system may be operated in a refueling mode (e.g., when fuel tank refueling is requested by a vehicle operator), wherein the controller 212 may open FTIV 252, while maintaining CPV 261 closed, to depressurize the fuel tank before allowing fuel to be added therein. As such, FTIV 252 may be kept open during the refueling operation to allow refueling vapors to be stored in the canister. After refueling is completed, the FTIV may be closed.

As yet another example, the fuel system may be operated in a canister purging mode (e.g., after an emission control device light-off temperature has been attained and with the engine running), wherein the controller 212 may open CPV 261 while closing FTIV 252. Herein, the vacuum generated by the intake manifold of the operating engine may be used to draw fresh air through vent line 227 and through the first canister 222 and the second canister 201 to purge the stored fuel vapors into intake manifold 244. In this mode, the purged fuel vapors from the canister are combusted in the engine. The purging may be continued until the stored fuel vapor amount in the canister is below a threshold. The FTIV 252 may be closed during the purging mode.

Controller 212 may comprise a portion of a control system 214. Control system 214 is shown receiving information from a plurality of sensors 216 (various examples of which are described herein) and sending control signals to a plurality of actuators 281 (various examples of which are described herein). As one example, sensors 216 may include manifold absolute pressure (MAP) sensor 224, barometric pressure (BP) sensor 246, exhaust gas sensor 226 located in exhaust manifold 248 upstream of the emission control device, temperature sensor 233, fuel tank pressure sensor 291 (also termed a fuel tank pressure transducer or FTPT), and canister temperature sensors 232, 203. Other sensors such as pressure, temperature, air/fuel ratio, and composition sensors may be coupled to various locations in the vehicle system 206. As another example, the actuators may include CPV 261, fuel injector 266, throttle 262, FTIV 252, fuel pump 221, and refueling lock 245. The control system 214 may include a controller 212. The controller may receive input data from the various sensors, process the input data, and trigger the actuators in response to the processed input data based on instruction or code programmed therein corresponding to one or more routines.

The controller 212 receives signals from the various sensors of FIG. 2 and employs the various actuators of FIG. 2 to adjust engine operation based on the received signals and instructions stored on a memory of the controller. For example, adjusting the canister purge valve may include adjusting an actuator of the canister purge valve to adjust a flow rate of fuel vapors therethrough. As such, controller 212 may communicate a signal to the actuator (e.g., canister purge valve solenoid) of the canister purge valve based on a desired purge flow rate. Accordingly, the canister purge valve solenoid may be opened (and pulsed) at a specific duty cycle to enable a flow of stored vapors from canisters to intake manifold 244 via purge line 228.

Turning now to FIG. 3, it shows an embodiment of a fuel system 300. The fuel system 300 may be used in the engine system of FIGS. 1 and/or 2. The fuel system 300 may include a fuel tank 302 configured to store one or more fuels. In one example, the fuel tank 302 may be similar to the fuel tank 220 of FIG. 2. The fuel tank 302 may include a port 304 to which a load line 306 is fluidly coupled. The load line 306 may be configured to flow fuel vapors to and/or from the fuel tank 302. A FTPT 308 may be coupled to the fuel tank 302 at a location proximal to the load line 306.

The fuel system 300 includes a first canister 320 and a second canister 340 coupled to the load line 306. In one example, the fuel system 300 is similar to the fuel system 218.

A variable bleed valve (VBV) 310 may be arranged along the load line 306. The VBV 310 may be coupled to a first canister load line 312 and a second canister load line 314. The first canister load line 312 may be coupled to the VBV 310 and a first canister inlet port 322 and flow. The second canister load line 314 may be coupled to the VBV 310 and a second canister inlet port 342. In one example, the VBV 310 is similar to the FTIV 252 of FIG. 2.

The VBV 310 may include a plurality of positions including a parallel position, a first open position, a second open position, and a closed position (herein, interchangeably referred to as a balance position). The parallel position may flow vapors to each of the first canister 320 and the second canister 340. The first open position may flow vapors from the fuel tank 302 to only the first canister 320. The second open position may flow vapors from the fuel tank 302 to only the second canister 340. The closed position may close the load line 306 from each of the first canister 320 and the second canister 340. In one example, the VBV 310 is a multi-way valve. The VBV 310 may include an actuator configured to receive signals from a controller (e.g., controller 212 of FIG. 2) and adjust a position of the VBV based on the received signals. Instructions stored on memory of the controller may cause the controller to adjust a position of the VBV 310 based on a loading of the first canister 320, the second canister 340, or both or in response to a fuel level.

Each of the first canister 320 and the second canister 340 may be coupled to a CPV 316. In one example, the CPV 316 may be identical to CPV 261 of FIG. 2. The CPV 316 may direct vapors to an engine intake during conditions, such as when combustion is occurring and fuel is being consumed. The first canister 320 may comprise a first canister purge line 324 and the second canister 340 may comprise a second canister purge line 344. The first canister purge line 324 may be coupled to the first canister 320 at a first canister purge port 326. The second canister purge line 344 may be coupled to the second canister 340 at a second canister purge port 346. The first canister purge line 324 and the second canister purge line 344 may intersect upstream of the CPV 316 relative to a direction of vapor flow.

Each of the first canister 320 and the second canister 340 may further include corresponding vent lines. The first canister 320 may include a first canister vent line 328 coupled to a first canister vent port 330 and a first canister vent valve (CVV1) 332. The second canister 340 may include a second canister vent line 348 coupled to a second canister vent port 350 and a second CVV (CVV2) 352. The first and second vent lines may be fluidly separated from one another. A dust box 362 may be fluidly coupled to each of the first canister vent line 328 and the second canister vent line 348. In some examples, the dust box 362 may be replaced with or include a bleed valve couple to atmosphere. Additionally or alternatively, the dust box 362 may be omitted and the vent lines may be directly coupled to atmosphere or optionally coupled to atmosphere via a bleed valve.

In one example, when the VBV 310 is in the closed position and balancing is desired, the CVV1 332 and CVV2 352 may be in a first open position and vapors may flow to the dust box 362. Vapors may return to the canisters if the dust box 362 is sealed from atmosphere, via a valve (not shown), wherein distribution of the vapors may balance a loading of the first and second canisters.

In one example, a length and a diameter of the lines to and from the canisters may be substantially identical. That is to say, a length and a diameter of the first load line 312 and the second load line 314 may be identical. A length and a diameter of the first canister purge line 324 and the second canister purge line 344 may be identical. A length and a diameter of the first canister vent line 328 and the second canister vent line 348 may be identical. A size, a shape, and a volume, including carbon bed, of the first canister 320 and the second canister 340 may be identical. By doing this, restrictions of the canisters may be substantially identical, thereby promoting more even vapor flow.

Additionally of alternatively, the VBV 310 may be actuated to a parallel open position. In the parallel open position, vapors from the fuel tank 302 may flow to each of the first load line 312 and the second load line 314. As such, each of the first canister 320 and the second canister 340 may receive vapors. The parallel open position may be selected in response to a refueling event or other operating condition where the engine is combusting and a diagnostic is not being executed.

The VBV 310 may further include a first open position and a second open position. In the first open position, vapors may flow to only the first load line 312. In the second open position, vapors may flow to only the second load line 314. Based on a position of CVV1 332 and CVV2 352, an order in which the first canister 320 and the second canister 340 receive vapors may be adjusted. This may be referred to herein as a fluid location, a fluid position, and/or a fluid orientation. That is to say, the first canister 320 and the second canister 340 are fixed and immovable. While a physical location of the first canister 320 and the second canister 340 is not changed, a fluid location of the canisters may be adjusted via adjusting a vapor flow path through the canisters. By adjusting a combination of the VBV 310, the CVV1 332, and the CVV2 352, a vapor flow path may travel through the first canister 320 prior to the second canister 340 or vice versa, thereby adjusting a fluid position of the canisters. The fluid position may be adjusted in response to a vehicle shut-off event free of a refueling event. Additionally or alternatively, the fluid position may be adjusted in response to a vehicle shut-off event longer than a determined time (e.g., 1 day) where diurnal vapor formation may exceed a threshold amount. The threshold amount may be based on a current load of a more loaded of the canisters, wherein the threshold amount decreases as the current load increases. The controller may predict the vehicle shut-off event duration based on a location in which the vehicle is parked (e.g., an airport), a vehicle operator's schedule, and the like. The fluid position may be adjusted to fluidly position a less loaded canister downstream of a more loaded canister, such that the less loaded canister may capture vapors leaving the more loaded canister. In one example, the more loaded canister may be prone to releasing vapors due to the diurnal temperatures, the less loaded canister may capture these vapors that would otherwise flow to atmosphere.

For example, if the VBV 310 is in the first open position and the CVV1 is in a divert position, then vapors may flow from the fuel tank to the first canister, through the first canister vent line 328, through the CVV1, to a first series passage 334, to the second load line 314, and into the second canister 340. The CVV2 may be in an open position such that vapors therefrom flow to the dust box 362. As such, vapor flow to the canisters may mimic a configuration where the canisters are arranged in series. As another example, if the VBV 310 is in the second open position and the CVV2 is in a divert position, then vapors may flow from the fuel tank to the second canister, through the second canister vent line 348, through the CVV2, to a second series passage 354, to the first load line 312, and into the first canister 320. The CVV1 may be in an open position such that vapors therefrom flow to the dust box 362.

As such, each of the CVV1 and the CVV2 may include three positions, including an open position, a divert position, and a closed position. The open position may fluidly couple a respective canister to the dust box 362. The closed position may seal a respective canister from the dust box 362. The divert position of the CVV1 may fluidly couple the first series passage to the second load line 314 and the divert position of the CVV2 may fluidly couple the second series passage to the first load line 312. When one of the CVV1 or the CVV2 is in the divert position, the other valve may be in the open position. By actuating the valves in this way, vapors may flow in parallel to both canisters or in series to the canisters, one at a time.

Turning now to FIG. 4, it shows a high-level flow chart 400 illustrating a method for adjusting a vapor flow path to a plurality of canisters. Instructions for carrying out method 400 and the rest of the methods included herein may be executed by a controller based on instructions stored on a memory of the controller and in conjunction with signals received from sensors of the engine system, such as the sensors described above with reference to FIGS. 1-3. The controller may employ engine actuators of the engine system to adjust engine operation, according to the methods described below.

The method 400 begins at 402, which includes determining one or more operating parameters. Operating parameters may include, but are not limited to, one or more of a throttle position, a manifold pressure, an engine speed, an engine temperature, a vehicle speed, and an air/fuel ratio.

At 404, the method 400 may include determining if a refueling event or a purging event is occurring. The controller may determine a refueling event is occurring based on a fuel level index (FLI) increasing, a vehicle location, and a refueling door position. For example, the FLI may be determined by the controller based on feedback from a fuel level sensor. If the FLI is increasing, then a refueling event may be occurring. The vehicle location may be determined based on feedback from a geolocating device, such as a navigation system, a GPS sensor, a mobile device, or the like. If the vehicle location corresponds to a refueling station, then a refueling event may be occurring. Additionally or alternatively, if the fueling door position is in an open position, then a refueling event may be occurring. The purging event may occur during operating conditions where the engine is combusting.

If the refueling event or purging event is occurring, then at 406, the method 400 may include adjusting the CVV1 and the CVV2 to open positions.

At 408, the method 400 may include adjusting the VBV to a parallel position and flowing vapors to the canisters in parallel. As such, vapors may flow from the fuel tank to each of the first canister and the second canister. Vapors from the canisters may flow through the open CVV1 and CVV2 toward the dust box and/or atmosphere, if a refueling event is occurring. As such, during refueling, vapors flowing to one canister may not flow to another canister based on the positions of the CVV1 and the CVV2. The canister loads may be naturally balanced during the refueling as a less loaded canister may initially receive more fuel vapors until backpressure generated by the less loaded canister is substantially equal to a more loaded canister.

If a purge event is occurring, vapors from the canisters may be directed to an engine, and not the dust box/atmosphere. As such, the CVV1 and the CVV2 may be adjusted to closed positions and the CPV may be adjusted to an open position. Vapors from one canister are blocked from entering the other.

Returning to 404, if a refueling/purging event is not occurring, then at 410, the method 400 may include determining if the vehicle is shut-off. The vehicle may be shut-off via an ignition key, a button, and/or a mobile device.

If the vehicle is not shut-off, then at 412, the method 400 may include determining if a diagnostic is occurring. The diagnostic may include a leak test of the fuel system and/or the evaporative emissions system. If the diagnostic is not occurring, then the method 400 may proceed to 406 as described above.

If the diagnostic is occurring, then at 414, the method 400 may include adjusting the CVV1 and the CVV2 to fully closed positions.

At 416, the method 400 includes sealing the canisters from atmosphere. As such, a leak in the system may be determined if a target pressure is not maintained.

Returning to 410, if the vehicle is shut-off then the method 400 proceeds to 502 of method 500 as shown in FIG. 5. The method 500 illustrates a configuration of the VBV, the CVV1, and the CVV2 to arrange the canisters in series during the vehicle shut-off to mitigate diurnal vapors escaping to atmosphere. During the shut-off, higher ambient temperatures may promote increased vapor formation which may The method may include determining a load of each of a plurality of canisters and arranged a least loaded canister in a most downstream position, relative to a direction of vapor flow, closest to atmosphere. For system including greater than two canisters, an order of the canisters may be based on loading, wherein more loaded canisters are arranged in upstream positions. For example, if three canisters are included in the system a load of the first canister is greater than a load of a second canister, and the load of the second canister is greater than a load of a third canister, then the first canister may receive vapors prior to the second canister and the second canister may receive vapors prior to the third canister. In some examples, the order may include arranging the least loaded canister in the most downstream position and arranging the other canisters independent of loading. The FLI may not increase during the method 500. As such, a refueling event is not occurring when the canisters are fluidly repositioned.

In some examples, additionally or alternatively, system including three or more canisters may include preferentially loading one of the canisters, such that one of the other less loaded canisters is available to arrange in the downstream position. By doing this, a system complexity (e.g., vapor passages and number of positions for the VBV and the CVVs) may be reduced, which may decrease a system cost.

The method 500 begins at 502, which includes determining a load of the canisters. In one example, the method may include determining a load of a plurality of canisters, such as the first canister and the second canister. Determining the load of the first canister may include actuating the CVV1 to the open position, actuating the CVV2 to the closed position, and actuating the VBV to the first open position. The FTPT may sense a pressure of the first canister, which may be correlated to its load. If the pressure is relatively high, then the load of the first canister may be relatively high. Determining the load of the second canister may include actuating the CVV2 to the open position, actuating the CVV1 to the closed position, and actuating the VBV to the second open position. The FTPT may sense a pressure of the second canister, which may be correlated to its load.

As another example, a load of the first canister and the second canister may be determined via an oxygen sensor. If the oxygen sensor senses a relatively low presence of oxygen (e.g., rich), then a canister loading may be relatively high. For example, the loading may be proportional to an $O_2$ rich shift magnitude. If the oxygen sensor senses lean, then the canister may be clean (e.g., unloaded).

At 504, the method 500 may include determining if a load of the first canister is greater than a load of the second canister. If the load of the first canister is greater than the load of the second canister, then at 506, the method 500 may include adjusting the VBV to the first open position and arranging the canisters in series. The first open position may direct fuel vapors from the fuel tank to only the first canister.

At 508, the method 500 may include commanding the CVV1 to the divert position. In one example, the divert position is a second open position of the CVV1 wherein fuel vapors leaving the canister flow through the CVV1 and into the first series passage.

At 510, the method 500 may include commanding the CVV2 to the open position (e.g., a first open position). The open position may allow vapors from the CVV2 to flow to atmosphere or a dust box positioned downstream of the first and second canisters.

At 512, the method 500 may include flowing vapors from the first canister, to the first series passage, and to the second canister. As such, the second canister is fluidly positioned downstream of the first canister via actuation of the VBV, CVV1, and CVV2 without physically relocating the canisters. This may allow the less loaded second canister to capture diurnal vapors generated during the vehicle shut-off Returning to 504, if the load of the first canister is not greater than the load of the second canister, then at 514, the method 500 may include determining if the load of the second canister is greater than the load of the first canister. If the load of the second canister is greater than the load of the first canister, then at 516, the method 500 may include adjusting the VBV to the second open position and fluidly arranging the canisters in series. As such, the VBV may direct fuel vapors from the fuel tank to only the second canister.

At 518, the method 500 may include commanding the CVV2 to the divert position. As such, fuel vapors exiting the second canister may enter the second series passage and flow to a load line of the first canister.

At 520, the method 500 may include commanding the CVV1 to the open position. Vapors from the first canister may now flow to atmosphere or to a dust box.

At 522, the method 500 may include flowing vapors from the second canister, to the second series passage, and to the first canister. As such, the first canister is fluidly positioned downstream of the second canister via actuation of the VBV, CVV1, and CVV2 without physically relocating the canisters. This may allow the less loaded second canister to capture diurnal vapors generated during the vehicle shut-off Returning to 514, if the load of the second canister is not greater than the load of the first canister, then at 524, the method 500 may include determining that the canisters are evenly loaded.

At 526, the method 500 may include adjusting the VBV, CVV1, and CVV2 to alternate canister positions based on previous shut-off orientation. For example, if during a previous vehicle shut-off event the first canister was configured in the fluidly downstream position, then during a current vehicle shut-off event the first canister may be configured in the fluidly upstream position. Additionally or alternatively, one of the first or second canister may be positioned in the downstream position as a default when the loads are equal.

Turning now to FIG. 6, it shows a plot 600 illustrating an operating sequence based on the methods of FIGS. 4-5 and the system of FIG. 3. Plot 610 illustrates if a refueling event is occurring. Plot 620 illustrates a first canister load. Plot 630 illustrates a second canister load. Plot 640 illustrates a VBV position. Plot 650 illustrates a CVV1 position. Plot 660 illustrates a CVV2 position. Plot 670 illustrates an initial vapor flow direction from the VBV. Plot 680 illustrates a vehicle shut-off condition. Time increase from a left to a right side of the figure.

Prior to t1, a refueling event is occurring (plot 610). The loads of the first and second canisters increase as fuel vapor flows to both canisters (plots 620 and 630, respectively). Thus, the VBV is in a parallel position and vapor flows to both canisters (plots 640 and 670, respectively). The CVV1 and CVV2 are in open positions At the t1, the FLI is equal to 50%. As such, the canister loading may be switched from the second canister to the first canister. To do so, the VBV is actuated to the first open position, the first CVV is actuated to the open position, and the second CVV is actuated to the closed position. The vehicle is shut-off (plot 680).

At t1, the refueling event is complete and the vehicle is no longer shut-off. Between t1 and t2, purging may occur, which reduces a load of each of the first and second canisters. The positions of the VBV, CVV1, and CVV2 are maintained in the parallel position and the open positions, respectively.

At t2, the vehicle is shut-off and refueling is not occurring. As such, a fuel level of a fuel tank may not increase or change. The VBV is actuated to the first open position due to the second canister load being less than the first canister load. The CVV1 is adjusted to the divert position and the CVV1 is maintained in the open position. Between t2 and t3, the vapor flows to only the first canister from the fuel tank. Vapor flow through the system may include vapor flowing from the fuel tank, through the VBV, to the first load line, to the first canister, to the first canister vent line, through the CVV1, to the first series passage, to the second load line, and to the second canister. Thus, the second canister, which is the less loaded canister, is fluidly arranged in a most downstream position closest to atmosphere and captures vapors flowing through the first canister.

At t3, the vehicle is turned on and the vehicle shut-off event is complete. The VBV is adjusted to the parallel position and the CVV1 is adjusted to the open position. After t3, vapor flows from the fuel tank to both the first canister and the second canister.

The technical effect of the evaporative system configuration is to provide benefits of both a parallel canister configuration and a series canister configuration. Positions of the valves of the evaporative system are adjusted to fluidly reposition a less loaded canister in a downstream position of a more loaded canister. By doing this, vapors leaked from the more loaded canister may be captured by the less loaded canister during a vehicle shut-off event.

The technical effect of arranging a three-way VBV valve between load lines of a first canister and a second canister arranged in parallel is to control vapor flow to each canister during a refueling event. The VBV may be further configured to block undesired backflow during a load measurement of either the first canister or the second canister. By doing this, vapor flow to atmosphere during the refueling event may be mitigated and an estimate of a load of the first canister and the second canister may be more accurate.

The disclosure provides support for a method for an evaporative emission control (EVAP) system including flowing vapors to canisters in parallel outside of a purging event and a refueling event; during a vehicle shut-off event not comprising the refueling event, flowing vapors to the canisters in series with a less loaded canister downstream of a more loaded canister. A first example of the method further includes flowing vapors to the canisters in parallel comprises adjusting a variable bleed valve (VBV) to a parallel open position, a first canister vent valve to an open position, and a second canister vent valve to an open position, wherein the parallel open position flows vapors from a fuel tank to all the canisters. A second example of the method, optionally including the first example, further includes flowing vapors to the canisters in series comprises adjusting the VBV to a first open position or a second open position, wherein the first open position flows vapors from a fuel tank to only one canister of the canisters. A third example of the method, optionally including one or more of the previous examples, further includes flowing vapors to the canisters in series further comprising adjusting a position of a canister vent valve of the more loaded canister to a divert position. A fourth example of the method, optionally including one or more of the previous examples, further includes flowing vapors further comprises flowing vapors from a vent line of the more loaded canister, through a series passage, to a load line of the less loaded canister, and to the less loaded canister.

The disclosure further provides support for an evaporative emission control (EVAP) system including a variable bleed valve (VBV) configured to adjust vapor flow from a fuel tank to a first load line of a first canister and a second load line of a second canister, a first canister vent valve (CVV1) configured to flow vapors from the first canister to a first vent line or a first series passage, a second canister vent valve (CVV2) configured to flow vapors from the second canister to a second vent line or a second series passage, and a controller comprising computer-readable instructions stored on memory thereof that when executed cause the controller to adjust the VBV to a first open position and the CVV1 to a first divert position in response to a load of the first canister being greater than a load of the second canister during a vehicle shut-off. A first example of the EVAP system further includes where the instructions further cause the controller to adjust the VBV to a second open position and the CVV2 to a second divert position in response to the load of the second canister being greater than the load of the first canister during the vehicle shut-off. A second example of the EVAP system, optionally including the first example, further includes where the instructions further cause the controller to adjust the VBV to a parallel position and the CVV1 and the CVV2 to an open position during a purging event and during the vehicle shut-off comprising a refueling event. A third example of the EVAP system, optionally including one or more of the previous examples, further includes where the first canister and the second canister are arranged in parallel. A fourth example of the EVAP system, optionally including one or more of the previous examples, further includes where the first series passage is coupled to the CVV1 and the second load line. A fifth example of the EVAP system, optionally including one or more of the previous examples, further includes where the second series passage is coupled to the CVV2 and the second load line. A sixth example of the EVAP system, optionally including one or more of the previous examples, further includes where the first vent line and the second vent line are coupled to atmosphere or a dust box. A seventh example of the EVAP system, optionally including one or more of the previous examples, further includes where a first purge line of the first canister and a second purge line of the second canister are coupled to a canister purge valve. An eighth example of the EVAP system, optionally including one or more of the previous examples, further includes where the first canister and the second canister are identical in size and shape. A ninth example of the EVAP system, optionally including one or more of the previous examples, further includes where the first open position comprises flowing vapors to only the first canister directly from the fuel tank.

The disclosure further provides support for a method for an evaporative emission fuel (EVAP) system including in response to a load of a first canister being greater than a load of a second canister during a vehicle shut-off event where a refueling event is not occurring, flowing vapors to only a first canister directly from a fuel tank via adjusting a variable bleed valve (VBV) to a first open position, further comprising flowing vapors from the first canister to the second canister via a first divert passage coupled to a first canister vent valve and in response to the load of the second canister being greater than the load of the first canister during the vehicle shut-off event where the refueling event is not occurring, flowing vapors to only the second canister directly from the fuel tank via adjusting the VBV to a second open position, further comprising flowing vapors from the second canister to the first canister via a second divert passage coupled to a second canister vent valve. A first example of the method further includes flowing vapors from the first canister to the second canister via the first divert passage coupled to the first canister vent valve further comprises adjusting the first canister vent valve to a first divert position. A second example of the method, optionally including the first example, further includes adjusting the first canister vent valve to an open position to flow vapors from the first canister to atmosphere or a dust box. A third example of the method, optionally including one or more of the previous examples, further includes flowing vapors from the second canister to the first canister via the second divert passage coupled to the second canister vent valve further comprises adjusting the second canister vent valve to a second divert position. A fourth example of the method, optionally including one or more of the previous examples, further includes adjusting the second canister vent valve to an open position to flow vapors from the second canister to atmosphere or a dust box.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for an evaporative emission control (EVAP) system, comprising:

flowing vapors to canisters in parallel outside of a purging event and a refueling event;

during a vehicle shut-off event not comprising the refueling event, flowing vapors to the canisters in series with a less loaded canister downstream of a more loaded canister.

2. The method of claim 1, wherein flowing vapors to the canisters in parallel comprises adjusting a variable bleed valve (VBV) to a parallel open position, a first canister vent valve to an open position, and a second canister vent valve to an open position, wherein the parallel open position flows vapors from a fuel tank to all the canisters.

3. The method of claim 2, wherein flowing vapors to the canisters in series comprises adjusting the VBV to a first open position or a second open position, wherein the first open position flows vapors from a fuel tank to only one canister of the canisters.

4. The method of claim 3, wherein flowing vapors to the canisters in series further comprising adjusting a position of a canister vent valve of the more loaded canister to a divert position.

5. The method of claim 4, wherein flowing vapors further comprises flowing vapors from a vent line of the more loaded canister, through a series passage, to a load line of the less loaded canister, and to the less loaded canister.

6. A evaporative emission control (EVAP) system, comprising:

a variable bleed valve (VBV) configured to adjust vapor flow from a fuel tank to a first load line of a first canister and a second load line of a second canister;

a first canister vent valve (CVV1) configured to flow vapors from the first canister to a first vent line or a first series passage;

a second canister vent valve (CVV2) configured to flow vapors from the second canister to a second vent line or a second series passage; and a controller comprising computer-readable instructions stored on memory thereof that when executed cause the controller to:

adjust the VBV to a first open position and the CVV1 to a first divert position in response to a load of the first canister being greater than a load of the second canister during a vehicle shut-off.

7. The EVAP system of claim 6, wherein the instructions further cause the controller to adjust the VBV to a second open position and the CVV2 to a second divert position in response to the load of the second canister being greater than the load of the first canister during the vehicle shut-off.

8. The EVAP system of claim 6, wherein the instructions further cause the controller to adjust the VBV to a parallel position and the CVV1 and the CVV2 to an open position during a purging event and during the vehicle shut-off comprising a refueling event.

9. The EVAP system of claim 6, wherein the first canister and the second canister are arranged in parallel.

10. The EVAP system of claim 6, wherein the first series passage is coupled to the CVV1 and the second load line.

11. The EVAP system of claim 6, wherein the second series passage is coupled to the CVV2 and the second load line.

12. The EVAP system of claim 6, wherein the first vent line and the second vent line are coupled to atmosphere or a dust box.

13. The EVAP system of claim 6, wherein a first purge line of the first canister and a second purge line of the second canister are coupled to a canister purge valve.

14. The EVAP system of claim 6, wherein the first canister and the second canister are identical in size and shape.

15. The EVAP system of claim 6, wherein the first open position comprises flowing vapors to only the first canister directly from the fuel tank.

16. A method for an evaporative emission fuel (EVAP) system, comprising in response to a load of a first canister being greater than a load of a second canister during a vehicle shut-off event where a refueling event is not occurring, flowing vapors to only a first canister directly from a fuel tank via adjusting a variable bleed valve (VB V) to a first open position, further comprising flowing vapors from the first canister to the second canister via a first divert passage coupled to a first canister vent valve; and in response to the load of the second canister being greater than the load of the first canister during the vehicle shut-off event where the refueling event is not occurring, flowing vapors to only the second canister directly from the fuel tank via adjusting the VBV to a second open position, further comprising flowing vapors from the second canister to the first canister via a second divert passage coupled to a second canister vent valve.

17. The method of claim 16, wherein flowing vapors from the first canister to the second canister via the first divert passage coupled to the first canister vent valve further comprises adjusting the first canister vent valve to a first divert position.

18. The method of claim 17, further comprising adjusting the first canister vent valve to an open position to flow vapors from the first canister to atmosphere or a dust box.

19. The method of claim 16, wherein flowing vapors from the second canister to the first canister via the second divert passage coupled to the second canister vent valve further comprises adjusting the second canister vent valve to a second divert position.

20. The method of claim 19, further comprising adjusting the second canister vent valve to an open position to flow vapors from the second canister to atmosphere or a dust box.

* * * * *